United States Patent [19]

Lindley et al.

[11] Patent Number: 4,956,881

[45] Date of Patent: Sep. 18, 1990

[54] HEAD SUPPORT APPARATUS

[76] Inventors: Stephen M. Lindley, 2400 Creekwood; Brandy L. Stein, 302 Denton St., both of Denton, Tex. 76205

[21] Appl. No.: 389,984

[22] Filed: Aug. 7, 1989

[51] Int. Cl.[5] ..... A45D 44/10

[52] U.S. Cl. ..... 4/517; 4/523; 4/575; 5/434

[58] Field of Search ..... 4/515, 516, 517, 519, 4/523, 575; 128/75, 76 R, 84 R, 84 C; 5/89, 434, 437; 297/395; 224/158; 272/94, 126, 133, 143

[56] References Cited

U.S. PATENT DOCUMENTS

| | | | |
|---|---|---|---|
| 70,555 | 11/1867 | Hale | 297/395 |
| 83,227 | 10/1868 | Warne | 297/395 |
| 806,565 | 12/1905 | Percy | 128/75 |
| 913,127 | 2/1909 | Haas | 128/75 |
| 963,890 | 7/1910 | Haas | 128/75 |
| 1,314,002 | 8/1919 | Lee | 128/75 |
| 1,557,055 | 10/1925 | Hoyle | 128/84 R |
| 1,855,408 | 4/1932 | Montenegro | 297/395 |
| 1,892,274 | 12/1932 | Henschen | 4/575 X |
| 2,701,564 | 2/1955 | Wilhelm | 128/75 |
| 4,546,504 | 10/1985 | Vars | 4/515 |
| 4,674,485 | 6/1987 | Swanson | 128/75 |

FOREIGN PATENT DOCUMENTS

| | | | |
|---|---|---|---|
| 559138 | 9/1923 | France | 272/94 |
| 1226506 | 7/1960 | France | 128/75 |

*Primary Examiner*—Henry J. Recla
*Assistant Examiner*—Robert M. Fetsuga
*Attorney, Agent, or Firm*—Richards, Medlock & Andrews

[57] ABSTRACT

Disclosed is apparatus for supporting a person's head in a support sling. Two sections of rope extend upward from the support sling. The upper ends of the rope sections are connected to a central section of rope to form a continuous loop. The central section of rope passes through a tube and over a pair of pulleys. An adjustable pulley, in the case of a wall mount, or an elliptical, metal ring, in the case of a ceiling mount, allow the sling to be raised and lowered. The person's head can be rotated as one section of rope moves upward and the other section of rope moves downward.

25 Claims, 2 Drawing Sheets

HEAD SUPPORT APPARATUS

This invention relates to apparatus for supporting a person's head while the person is lying on his or her back. More particularly, it relates to apparatus for supporting a person's head over a sink while the person's hair is being washed, rinsed or treated in some other manner.

Often when a person's hair is being washed or rinsed, the person will lie on his or her back and extend his or her head over a sink or shampoo bowl. Many shampoo bowls designed for such use have a special U-shaped depression for supporting the person's neck.

Although the neck is supported, either the person being treated or the person administering the treatment must support the weight of the head. If a person must support his or her own head, he or she may become fatigued or the muscles in his or her neck may tighten up. If the person administering the treatment must use one hand to support the head, then administering the treatment is much more difficult. Clearly, it is advantageous for there to be some apparatus for supporting the person's head so that neither person has to hold the head.

There have been in the past several devices for supporting a person's head during washing or rinsing. For example, U.S. Pat. No. 4,546,504 issued on Oct. 15, 1985 to Vars shows a head support having a support sling. The sling is held in place by a cord which passes through the sling. The ends of the cord are attached to the sidewalls of the basin with a pair of hooks.

The apparatus of this invention also includes a support sling for holding the head. However, each end of the sling is attached to the two ends of a rope. The two end sections of rope extend upwardly from the ends of the sling and are connected in a continuous loop.

The continuous loop of rope is held above the head by a pair of pulleys. The pulleys may be located within the ends of a tube or the like through which the central section of rope passes. The tube and the pulleys are supported by support means such as a bracket attached to a wall.

The head is held by the support sling and can be rotated approximately forty-five degrees in either direction, because as one section of the rope moves upward, the other section of rope moves downward. It is thus much easier to wash or rinse all of the person's hair.

The support sling can be raised and lowered to adjust size of the person's head. One means for raising and lowering the sling is an adjustable pulley which engages the central section of rope. Another means for raising and lowering the sling is a metal ring which holds the two sections of the rope together at a selected point. The ring can be moved upward and downward along the sections of the rope. As the ring is moved upward the person's head is raised and as the ring is moved downward the head is lowered.

Other features and advantages of the invention will become more readily understood from the following detailed description taken in connection with the appended claims and attached drawings in which:

Figure 1:
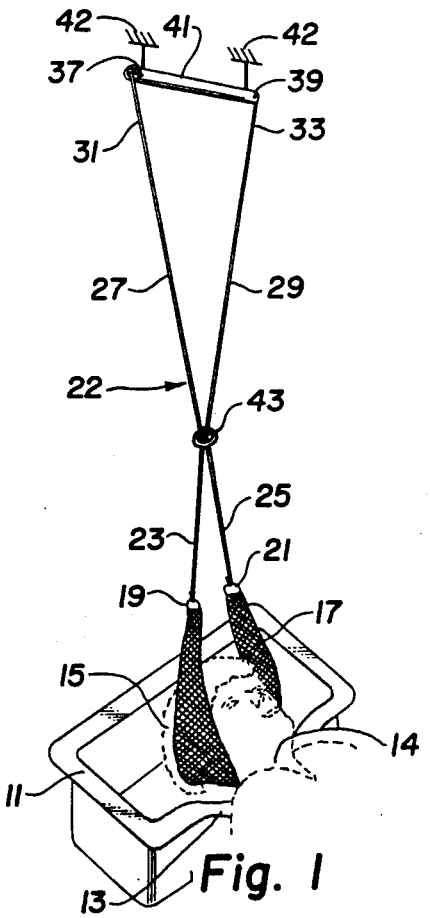
FIG. 1 is a perspective view of one embodiment of the invention.
Figure 2:
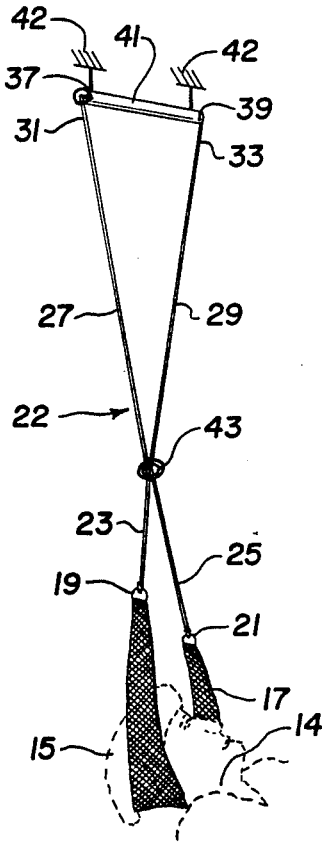
FIG. 2 is a perspective view of the apparatus shown in FIG. 1 shown with the head pivoted to one side.

As shown in FIGS. 1 and 2, the apparatus of the invention may be installed above a shampoo bowl 11. A typical shampoo bowl 11 has a U-shaped depression 13 so a person can rest his or her neck 14 on the U-shaped depression 13 with his or her head 15 extending over the shampoo bowl 11.

The apparatus of the invention includes a mesh support sling 17 adapted to be placed under the back of the head 15. The support sling 17 is elliptical and the two ends 19 and 21 of the sling 17 extend upwardly on either side of the person's head 15. The mesh construction of the support sling 17 allows water and other liquids to flow through the support sling 17. The support sling 17 is preferrably constructed of a water resistant material such as polyethylene or the like.

The ends 19 and 21 of the support sling 17 are connected to a rope 22. The rope 22 could also be a cord, string or the like. The rope 22 has two sections 23 and 25 and a central section 35. Each end 19 and 21 of the support sling 17 is connected to the lower end 23 and 25 of a section 27 and 29 of rope. Each section 27 and 29 of rope extends upward from the ends 19 and 21 of the support sling 17. The upper ends 31 and 33 of the two sections 27 and 29 of rope are connected to the central section 35 of rope.

Figure 3:
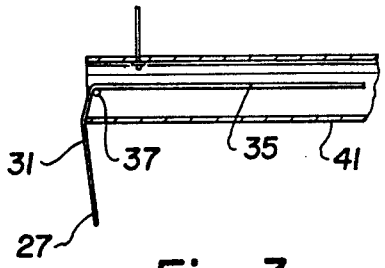
FIG. 3 is a close-up view, partially in section, of the tube shown in FIG. 1.

As shown in FIG. 3, the central section 35 of rope passes over a pair of pulleys 37 and 39 and through a tube 41. The two pulleys 37 and 39 are preferably a pair of rotating pins 37 and 39 mounted near the ends of the tube 41. The tube 41 may be a small piece of plastic pipe. The tube 41 is supported by a bracket 42 as shown in FIGS. 1 and 2. The bracket 42 may be attached to a wall or a ceiling. The apparatus of the invention could be constructed without the pulleys 37 and 39, but the central section 35 of the rope might wear excessively on the ends of the tube 41.

As shown in FIGS. 1 and 2 an elliptical, metal ring 43 holds the two sections 27 and 29 of rope together at a selected point. The ring 43 can be moved upward and downward on the sections 27 and 29 of rope. The pulleys 37 and 39 are located at the ends of the tube 41 and are farther apart than the ends 19 and 21 of the support sling 17. Therefore, as the ring 43 moves upward, the geometry of the apparatus causes the support sling 17 and the person's head 15 to be raised. Likewise, as the ring 43 is moved downward the supporting sling 17 and the person's head 15 are lowered.

Operation of the apparatus of the invention is illustrated in FIGS. 1 and 2. The apparatus is installed above a shampoo bowl 11. A person lies on his or her back with his or her head 15 in the support sling 17. The metal ring 43 can be moved upward or downward to adjust the height of the support sling 17 and the head 15 the person's head 15 is thus suspended over the shampoo bowl 11 without having to be held by hand If desired, the head 15 can be rotated about forty-five degrees in either direction. As shown in FIG. 2, as the person's head 15 is rotated one of the sections 27 of rope moves upward as the other section 29 of rope moves downward. As the sections 27 and 29 of rope move, the ring 43 remains in its original position.

Figure 4:
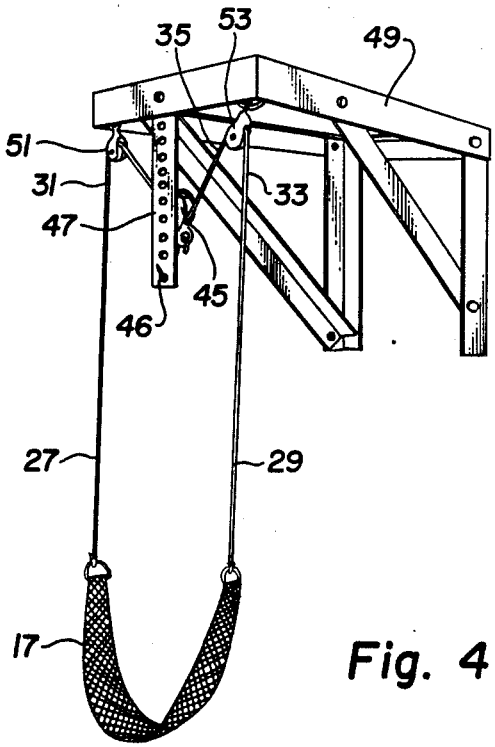
FIG. 4 is a perspective view of a second embodiment of the invention.

FIG. 4 illustrates a different means for raising and lowering the support sling 17. In this embodiment an adjustable pulley 45 engages the central section 35 of rope. The adjustable pulley 45 is mounted in a selected hole 46 in a pulley mount 47 which is attached to a bracket 49 mounted on a wall.

The central section 35 of rope passes over a pair of pulleys 51 and 53 which are also mounted on the bracket 49. The central section 35 of rope is then attached to the upper ends 31 and 33 of the other two sections 27 and 29 of rope.

The adjustable pulley 45 is adjusted by moving the pulley 45 to a different hole 46 in the pulley mount 47. If the adjustable pulley 45 is lowered, the support sling 17 is raised. Conversely, if the adjustable pulley 45 is raised, the support sling 17 is lowered.

The apparatus of the invention has several advantages over the prior art. The head 15 can be rotated easily without ever losing any of the support while rinsing. The sections 27 and 29 of rope extend upward from the support sling 17 so that sections 27 and 29 do not get in the way of the spray nozzle while rinsing.

The large mesh of the support sling 17 allows liquids to flow more easily through the sling 17. The shape of the sling 17 fits the head 15 more closely for a more comfortable fit and to better hold permanent wave rods in place while rinsing. Also, the larger surface area of the sling 17 distributes the weight of the head 15 more widely so that there is less pressure per square inch across the back of the head, as opposed to all the weight of the head resting on the neck and nape area of the scalp. Accordingly, while the invention has been described with particular reference to two specific embodiments thereof, various changes and modifications may be resorted to without departing from the spirit and scope of the invention as defined by the appended claims.

What is claimed is:

1. Apparatus for supporting a person's head comprising:

a support sling adapted to be placed under the back of the person's head wherein each end of the sling extends upward on either side of the person's head;

a rope having two sections, each section of rope being attached to one end of the sling wherein the two sections of rope extend upward from the sling;

holding means for holding the two sections of rope above the person's head; and means operatively interconnecting the two sections of rope above the person's head so that when the person's head is rotated one section of rope moves upward and the other section of rope moves downward.

2. Apparatus as defined in claim 1 wherein the rope includes a central section of rope between the upper ends of the two sections of rope and the holding means includes a tube which covers the central section of the rope and support means for supporting the tube above the person's head.

3. Apparatus as defined in claim 1 wherein the holding means includes a pulley and support means for supporting the pulley above the person's head.

4. Apparatus as defined in claim 3 wherein the holding means also includes a second pulley and the rope includes a central section of rope between the upper ends of the other two sections of rope to form a continuous loop.

5. Apparatus as defined in claim 4 wherein the distance between the two pulleys is greater than the distance between the two ends of the sling when contoured snugly around the back of the person's head.

6. Apparatus as defined in claim 4 wherein the holding means also includes a tube which covers the central section of the rope and the two pulleys.

7. Apparatus as defined in claim 1 wherein the support sling allows liquids to drain through the sling.

8. Apparatus as defined in claim 1 wherein the support sling is made of mesh material.

9. Apparatus as defined in claim 1 further including means for raising and lowering the height of the support sling.

10. Apparatus as defined in claim 9 wherein the holding means includes a central section of rope between the upper ends of the two sections of rope and the means for raising and lowering the support sling includes an adjustable pulley, wherein the central section of rope engages the adjustable pulley.

11. Apparatus as defined in claim 9 wherein the means for raising and lowering the support sling includes a ring for holding the two sections of rope together at a selected point.

12. Apparatus as defined in claim 11 wherein the ring can be moved upward and downward on the two sections of rope to raise and lower the person's head.

13. Apparatus for supporting a person's head comprising:

a support sling made of a mesh material to allow liquids to drain through the sling and adapted to be placed under the back of the person's head so that each end of the sling extends upward on either side of the person's head;

two sections of rope, each section of rope being attached to one end of the sling, wherein the two sections of rope extend up sling;

a central section of rope connected between the upper ends of the two sections rope to form a continuous loop;

a pair of pulleys for supporting the central section of rope wherein the distance between the two pulleys is greater than the distance between the two ends of the sling when contoured snugly around the back of the person's head;

a tube which covers the central section of the rope and the two pulleys;

a bracket for supporting the tube and the pulleys above the person's head; and a ring for holding the two sections of the rope together at a selected point wherein the ring can be moved upward and downward on the rope to raise and lower the person's head.

14. Apparatus for supporting a person's head comprising:

a support sling made of a mesh material to allow liquids to drain through the sling and adapted to be placed under the back of the person's head so that each end of the sling extends upward on either side of the person's head;

two sections of rope, each section of rope being attached to one end of the sling, wherein the two sections of rope extend upward from the sling;

a central section of rope connected between the upper ends of the two sections rope to form a continuous loop;

a pair of pulleys for supporting the central section of rope wherein the distance between the two pulleys is greater than the distance between the two ends of the sling when wrapped snugly around the person's head;

a bracket for supporting the pair of pulleys above the person's head;

a pulley mount attached to the bracket; and an adjustable pulley mounted on the pulley mount wherein the adjustable pulley engages the central section of rope and wherein the adjustable pulley can be raised and lowered on the pulley mount to raise and lower the support sling.

15. Apparatus for supporting a person's head comprising:

a support sling adapted to be placed under the back of the person's head wherein each end of the sling extends upward on either side of the person's head;

a rope having two sections, each section of rope being attached to one end of the sling wherein the two sections of rope extend upward from the sling;

a central section of rope between the upper ends of the two sections of rope; and holding means for holding the two sections of rope above the person's head so that as the person's head is rotated one section of rope moves upward as the other section of rope moves downward, said holding means including a tube which covers the central section of the rope and support means for supporting the tube above the person's Head.

16. Apparatus as defined in claim 15 wherein the holding means includes a pulley and support means for supporting the pulley above the person's head.

17. Apparatus as defined in claim 16 wherein the holding means also includes a second pulley and the central section of rope between the upper ends of the two sections of rope forms a continuous loop.

18. Apparatus as defined in claim 17 wherein the distance between the two pulleys is greater than the distance between the two ends of the sling when contoured snugly around the back of the person's head.

19. Apparatus as defined in claim 17 wherein the tube covers the central section of the rope and the two pulleys.

20. Apparatus as defined in claim 15 wherein the support sling allows liquids to drain through the sling.

21. Apparatus as defined in claim 15 wherein the support sling is made of mesh material.

22. Apparatus as defined in claim 15 further comprising means for raising and lowering the height of the support sling.

23. Apparatus as defined in claim 22 wherein the means for raising and lowering the support sling includes a ring for holding the two sections of rope together at a selected point.

24. Apparatus as defined in claim 23 wherein the ring can be moved upward and downward on the two sections of rope to raise and lower the person's head.

25. Apparatus for supporting a person's head comprising:

a support sling made of a mesh material to allow liquids to drain through the sling and adapted to be placed under the back of the person's head so that each end of the sling extends upward on either side of the person's head;

two sections of rope, each section of rope being attached to one end of the sling, wherein the two sections of rope extend upward from the sling;

a central section of rope connected between the upper ends of the two sections of rope forming a continuous loop;

a pair of pulleys for supporting the central section of rope wherein the distance between the two pulleys is greater than the distance between the two ends of the sling when contoured snugly around the back of the person's head;

means for supporting the pulleys above the person's head; and means for holding the two sections of the rope together at a selected point and movable upward and downward on the rope to raise and lower the person's head.

* * * * *